US006301751B1

(12) United States Patent
Ohlson

(10) Patent No.: US 6,301,751 B1
(45) Date of Patent: Oct. 16, 2001

(54) HOOK-SHAPED ARRANGEMENT

(76) Inventor: Kurt Lennart Ohlson, Ekvägen 8, 186 70 Brottby (SE)

( * ) Notice: Subject to any disclaimer, the term of this patent is extended or adjusted under 35 U.S.C. 154(b) by 0 days.

(21) Appl. No.: 09/423,251

(22) PCT Filed: May 4, 1998

(86) PCT No.: PCT/SE98/00814

§ 371 Date: Nov. 5, 1999

§ 102(e) Date: Nov. 5, 1999

(87) PCT Pub. No.: WO98/51187

PCT Pub. Date: Nov. 19, 1998

(30) Foreign Application Priority Data

May 9, 1997 (SE) ..... 9701743

(51) Int. Cl.[7] ..... A44B 21/00; A44C 3/00

(52) U.S. Cl. ..... 24/3.11; 24/3.6; 24/3.12; 24/597

(58) Field of Search ..... 24/3.11, 3.12, 24/3.6, 596, 663

(56) References Cited

U.S. PATENT DOCUMENTS

| | | | | |
|---|---|---|---|---|
| D. 358,475 | * | 5/1995 | Choksi et al. | D3/203 |
| 1,207,154 | | 12/1916 | Fox . | |
| 1,353,605 | * | 9/1920 | Napolillo | 24/3.12 |
| 2,775,804 | * | 1/1957 | Ayoub | 24/3.12 |
| 4,277,863 | * | 7/1981 | Faneuf | 24/3.12 |
| 4,974,764 | | 12/1990 | Cantwell . | |
| 5,564,166 | * | 10/1996 | Roy | 24/3.11 |
| 5,640,742 | * | 6/1997 | White et al. | 24/3.12 |

FOREIGN PATENT DOCUMENTS

| | | |
|---|---|---|
| 2103270 | 2/1983 | (GB) . |
| 60 984 | 4/1997 | (SE) . |

* cited by examiner

*Primary Examiner*—Victor N. Sakran
(74) *Attorney, Agent, or Firm*—Burns, Doane, Swecker & Mathis, L.L.P.

(57) ABSTRACT

The present invention relates to a hook-shaped arrangement (1) which comprises a main part (1*a*), a hook-shaped device (1*b*) integral with said main part, and a holding means (2) which is integral with or attached to said main part. The hook-shaped device (1*b*) is comprised of a tongue (5) which is part-circular, or at least essentially part-circular in cross section and has an angle of arc slightly below 360°. The center (5') of the curved tongue is located in a plane (A) which coincides with a plane (A') that lies on one side surface (7) of the main part. The free end (5*a*) of the tongue extends in a plane (B) that coincides with a plane (B') lying on that side surface (8) of the main part opposite to said one side surface (7) of said main part.

17 Claims, 2 Drawing Sheets

HOOK-SHAPED ARRANGEMENT

FIELD OF INVENTION

The present invention relates to a hook-shaped arrangement and more particularly to a hook-shaped arrangement that comprises a main part, a hook-shaped device integral with said main part, and a holding device which is either integral with or attached to said main part.

The hook-shaped device is formed at one end of the main part and is adapted so that although it can be easily affixed to an object, it can only be removed from said object with difficulty, whereas the holding device is either formed integrally with or is attachable to the other end of the main part of said device and is adapted to be readily applied to a holding means so as to be readily fastened to and readily removed therefrom.

The present invention is primarily intended for use with an object, such as an identity card, and the holding means may comprise a chosen part of a person's clothing, such as the edge of a breast pocket.

BACKGROUND OF THE INVENTION

Several different kinds of such hook-shaped object holding arrangements that have a use-appropriate design are known to the art.

For instance, it is known to hang pictures, paintings, on walls with the aid of a picture hook where the holding device is comprised of a hole and a nail and where the hook-shaped device includes an angle of 180° or slightly less.

It is also known to provide a separate unit which functions to prevent the picture cord leaving the hook-shaped device unintentionally.

Swedish Design Application 96-1094, registration number 60984, Apr. 30, 1997, describes a hook-shaped arrangement adapted for such application. In this case, the hook-shaped arrangement is comprised of a part which is partly circular in cross-section and which includes an angle of arc of slightly less than 360°.

This Design Application also discloses that the centre of said curved part is positioned in, or at least substantially in, a plane that extends through a central plane of the main part.

The device also includes a suitable slot between the free end of the curved part and said main part, while the free end of the curved part is angled away from said main part.

It is also evident from the Design Application that the main part has the same thickness as the curved part.

SUMMARY OF THE INVENTION

TECHNICAL PROBLEMS

When taking into consideration the technical deliberations that a person skilled in this particular art must undertake in order to provide a solution to one or more technical problems that he/she encounters, it will be seen that on the one hand it is necessary initially to realize the measures and/or the sequence of measures that must be undertaken to this end, and on the other hand to realize which means is/are required in solving one or more of said problems. On this basis, it will be evident that the technical problems listed below are highly relevant to the development of the present invention.

When considering the present state of the art as described above, it will be seen that in respect of a hook-shaped arrangement of the aforedescribed kind, a technical problem resides in the ability to create constructive conditions which will enable the hook-shaped device to be produced readily by means of a moulding process or like process in a two-part matrix and thereafter adapt said device such that while it can be easily applied to an object and therewith secure said object firmly, it can only be removed therefrom with difficulty.

Another technical problem is one of enabling said hook-shaped arrangement to be produced from a suitable and durable plastic material, and to adapt said hook-shaped device so that it can be caused to co-act readily with an identify card or like object with the main part of the hook-shaped device and said identity card being in specific alignment with one another.

Another technical problem is one of providing such a device that will ensure that the main part and the identity card will be positioned closely adjacent one another.

In this respect, a further technical problem is one of designing the hook-shaped device such that when a slotted identity card is caused to co-act with the hook-shaped device, it will only be possible to remove the identity card from said device after having turned the identity card about a horizontal rotational axis through an angle of 180° from its normal suspended position and into abutment with said main part, without needing to manipulate the hook-shaped device.

It will also be seen that a technical problem resides in configuring the hook-shaped device in relation to a slotted identity card co-acting therewith such that this mutual co-action will remain intact in each other position of rotation between the identity card and the hook-shaped device or the main part of said device.

It will also be seen that a technical problem resides in providing a hook-shaped device to which a chosen slotted identity card can be readily attached in co-action with said hook-shaped device.

It will also be seen that a technical problem resides in realizing the significance of and the advantages associated with allowing the center of a curved tongue on the hook-shaped device to be position in, or essentially in, a plane that coincides with a plane on one of the side surfaces of said main part.

Another technical problem is one of realizing the significance of and the advantages associated with allowing the free end of said tongue to extend in, or essentially in, a plane that coincides with a plane on that side surface of said main part which lies opposite to said one side surface of said main part.

It will also be seen that a technical problem is one of realizing the significance of allowing the angle of arc of the circular tongue to be greater than 300° but smaller than 340°.

Another technical problem is one of realizing the significance of giving the tongue a thickness that is half the thickness, or essentially half the thickness, of the main part.

It will also be seen that a technical problem is one of realizing the significance of and the advantages afforded by providing or forming on one end of the main part a projection that faces towards said tongue and that is positioned close to the side surface of said main part that lies opposite said one side surface of said main part and that is positioned in the region between said opposing side surfaces.

Another technical problem is one of realizing the significance of positioning the center of said curved tongue on one side of a plane on one of the side surfaces of said main part and extending from said plane on that side surface of the main part which lies opposite to said one side surface of said main part.

Another technical problem is one of realizing the significance of providing said main part in the proximity of said other end with one or two circular, barbed projections that will enable the hook-shaped device to be secured firmly to a holding means and rotated relative thereto when necessary.

In the case of a first type of projection, a technical problem resides in realizing the significance of providing said projection on one side surface of said main part and adapting said projection for a first type of holding means, such as a suspenders clip.

Another technical problem is one of realizing the significance of providing a second type of projection on that side surface of the main part which lies opposite said one side surface of said main part and which is adapted for co-action with another type of holding means, such as a crocodile clip.

It will also be seen that another technical problem is one of realising the significance of and the advantages afforded by providing conditions in which the diameter of the curved tongue is equal to the thickness of the tongue and is slightly less than the distance from an outer edge of an identity card to the slotted defining edge of said card opposite to said outer edge.

Another technical problem is one of realising the significance of and the advantages associated with producing said main part and said hook-shaped, tongue-like device from a plastic material, such as polycarbonate, such that said main part and said hook-shaped device can be produced in a two-part matrix, by means of an extrusion process or like process.

Another technical problem is one of realizing the significance of and the advantages that are afforded by allowing the free end of the tongue to present a bevelled or rounded surface to one of the side surfaces of said main part.

SOLUTION

The present invention is based on a hook-shaped arrangement of the kind described in the introduction.

With the intention of solving one or more of the aforesaid technical problems, it is particularly proposed that a hook-shaped device shall comprise a tongue which is partly circular in cross-section, or at least essentially partly circular, having an angle of arc that is slightly less than 360°, and that the center of the curved tongue is located in, or essentially in, a plane that is orientated to coincide with a plane on one side surface of said main part, and that the free end of the tongue extends in, or at least essentially in, a plane that is orientated to coincide with a plane on that side surface of the main part which lies opposite to said one side surface of said main part.

In respect of further embodiments that lie within the scope of the inventive concept, it is proposed that the angle of arc of the circular tongue is greater than 360° and less than 340°.

It is also proposed that the tongue will have a thickness which is half the thickness, or at least essentially half the thickness, of the main part.

It is also proposed that the tongue will have a width which is equal to or at least essentially equal to the width of the main part, and that the width chosen will be slightly smaller than the length of a slot provided in an identity card in the proximity of an outer edge-part of said card.

It is also proposed in accordance with the invention that one end of the main part of said device will include a projection that faces towards said tongue and that is located adjacent that side surface of said main part which lies opposite to said one side surface of the main part and located between said opposing side surfaces.

It is also proposed that the center of said curved tongue will be located on one side of a plane on one side surface of the main part of the device and in a direction from said plane located on the side surface of said main part that lies opposite said one of said main-part side surfaces.

In this regard, it is proposed that the angle of arc contained by said circular, curved tongue section is greater than 320° and smaller than 350°.

It is also proposed in accordance with the invention that the second end of the main part shall include one or more circular, barbed projections which will enable the hook-shaped device to be secured firmly to a holding means and rotated in relation thereto when necessary.

According to one embodiment of the invention, one side surface of the main part includes a first type of projection by means of which the hook-shaped device can be firmly secured to a first type of holding means, such as a suspender clip.

That side surface of the main part opposite to said one side surface of said main part will conveniently include a second type of projection which enables the hook-shaped device to be secured firmly to a second type of holding means, such as a crocodile clip.

The diameter of the curved tongue and the thickness of the tongue will conveniently be less than the distance from one outer edge of the identity card to a slotted card-delimiting edge facing towards said outer edge.

The main part and the hook-shaped device belonging to said hook-shaped device may conveniently be made of a plastic material, and then particularly a polycarbonate material.

The free end of the tongue will preferably have a bevelled or rounded surface that faces towards said one side surface of said main part.

ADVANTAGES

Those advantages primarily afforded by an inventive hook-shaped arrangement are found in the provision of conditions whereby the main part and a hook-shaped device formed integrally therewith can be produced in a simple manner and so that said device can be readily attached to an object with the hook-shaped device and said object in chosen relative positions, wherewith, when applied, the hook-shaped device will hold the object securely, i.e. an identity card and can only be removed from said holding means with difficulty. One edge of the identity card can be easily inserted into the hook-shaped device, by allowing the slot in said card to pass around the part-circular tongue. With the card secured in this way, the card can only be removed by rotating the card to a position parallel with and close to said one side surface of the main part.

Manufacture of the hook-shaped arrangement from a plastic material, preferably a polycarbonate material, will ensure durable and positive co-action between the hook-shaped device and the identity card.

The primary characteristic features of an inventive hook-shaped arrangement are set forth in the characterizing clause of the following Claim 1.

BRIEF DESCRIPTION OF THE DRAWINGS

So that the invention will be more readily understood and further features thereof made apparent, the invention will now be described in more detail with reference to embodiments at present preferred and also with reference to the accompanying drawings, in which.

DETAILED DESCRIPTION OF EMBODIMENTS AT PRESENT PREFERRED

Figure 1:
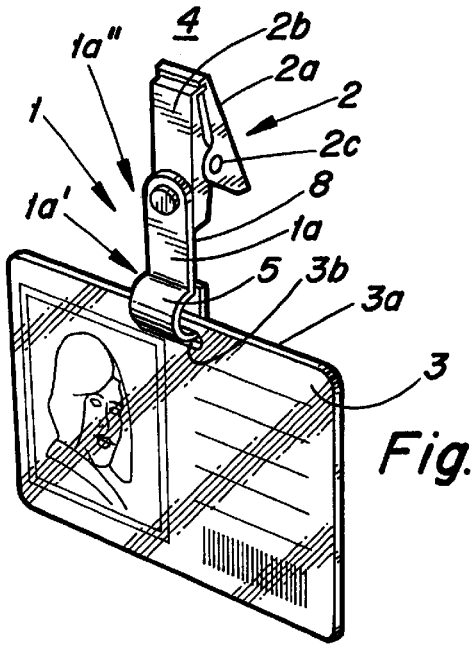
FIG. 1 is a perspective illustration of a hook-shaped arrangement with its hook-shaped device shown in co-action with an identity card and with a main part of said arrangement shown in co-action with a holding means in the form of a crocodile clip.

FIG. 1 is a perspective view of a hook-shaped arrangement 1 which includes a main part 1*a*, a hook-shaped device 1*b* integral with said main part and a holding means 2 attached to the main part.

The hook-shaped device 1*b* is formed at one end 1*a*' of the main part 1*a* and is adapted to firmly hold an object, such as the identity card 3 shown in FIG. 1, while being not readily removable from said object.

The holding means 2 can be attached to the other end 1*a*" of the main part 1*a* and functions to secure the device to a holding means 4, such as part of a wearer's clothing. This holding means 4 is only indicated in FIG. 1.

Figure 2:
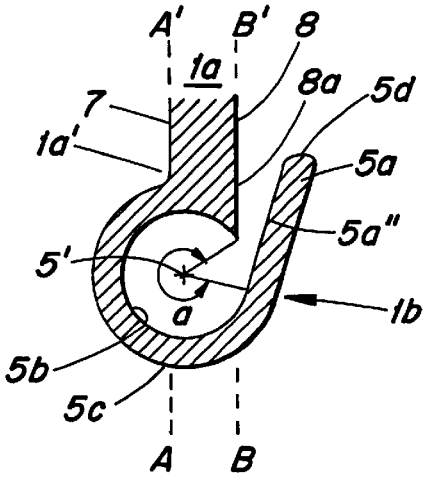
FIG. 2 is a side view of a hook-shaped device, immediately after being moulded in a two-part matrix.

FIG. 2 is a side view which shown one end 1*a*' of the main part 1*a* and the shape of the hook-shaped device 1*b* immediately after its manufacture. The hook-shaped device 1*b* and the main part 1*a* are moulded from a plastic material in a two-part matrix. As will be seen from FIG. 2, the hook-shaped device 1*b* includes a tongue 5 whose free end 5*a* is divergent in relation to the main part 1*a*, said tongue 5 being brought to the state shown in FIG. 3 by subsequent cooling of said tongue.

FIG. 2 is intended to show that cooling of a plastic component will result in a shape change that can be utilized in accordance with the present invention.

Figure 3:
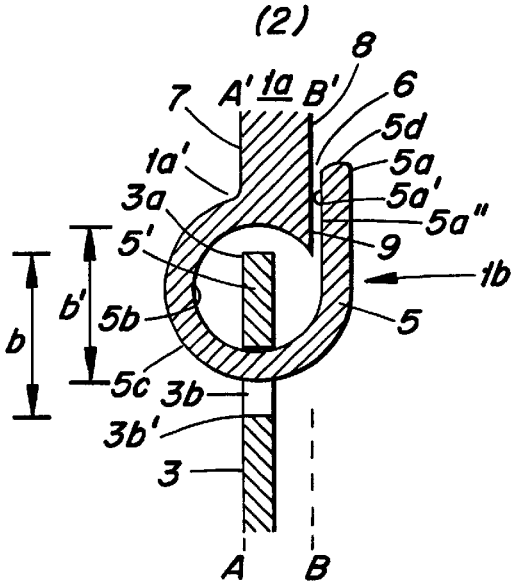
FIG. 3 is a sectional side view of the hook-shaped device and shows said device in co-action with a slotted identity card.

Regardless of the measures taken, the end product, shown in FIG. 3, shall present a very small gap 5*a*' between the free end 5*a* and a region 8*a* of the main part of said device, this region being flat in the illustrated case.

There is nothing to prevent the free end 5*a* being pressed resiliently towards or against the region 8*a*.

The term "tongue" as used in this document is meant to illustrate that the hook-shaped device 1*b* has a thickness which is smaller than the thickness of the main part 1*a*.

The hook-shaped device 1*b* is comprised of a circular-arcuate part 5*c* that has an inner surface 5*b* which includes an angle of arc "a" and a straight, free end 5*a*. The length of the free end 5*a* corresponds to, or at least essentially to, the diameter of the arcuate part 5*c*. The end 5*a* will preferably be slightly longer than said diameter.

FIG. 3 shows the main part 1*a* and the hook-shaped device 1*b* in a final state in which a slot 6 or like aperture is formed at the terminating part of the free end 5*a*. The tip of the free end 5*a* is rounded or bevelled at 5*d* so as to define the slot 6.

When attaching an identity card to the hook-shaped device 1*b*, the edge 3*a* of said card is caused to connect with the slot 6, so that the card 3 takes a position immediately adjacent to or against the surface 8 of the main part 1*a*, therewith enabling the edge 3*a* to be inserted into the interior of the hook-shaped device 1*b* and the rounded or bevelled tip 5*d* to pass through a slot 5*a*', so that the hook-shaped device 1*b* and the identity card 3 are able to take the position shown in FIG. 3, this position corresponding to that shown in FIG. 1.

This enables the hook-shaped device 1*b* to co-act readily with the slot 3*b* in the card 3.

The hook-shaped device 1*b* has the form of a tongue 5 which is partly circular, or at least essentially part-circular, in cross-section.

The expression "partly circular" shall be understood as meaning a circular section 5*c* that does not form a closed circle but that has an angle of arc which is smaller than 360° and/or that section 5*c* has a cross-sectional shape that deviates slightly from a circular shape.

The circular part 5*c* of the tongue 5 shall then have an angle of arc (a) that is only slightly smaller than 360° in practice.

A center 5' on the circular part 5*c* lies in, or at least essentially in, a plane "A" that is able to coincide with a plane "A'" that lies on and coincides with one of the side surfaces 7 of the main part 1*a*, and the free end 5*a* of the tongue 5 extends in, or at least essentially in, a plane "B" that is able to coincide with a plane "B'" which lies in and coincides with the side surface 8 of the main part 1*a* that lies opposite said one surface 7 of the two opposing side surfaces 7, 8 of the main part.

This definition may, more specifically, be taken to mean a surface 5*a*" of the free end 5*a* that defines the gap 5*a*'.

The angle of arc of the circular arc 5*c* is greater than 300° and smaller than 340°, with the inner circular surface 5*b* of the hook-shaped device 1*b* being able to touch the plane "B", i.e. to be tangential to said plane.

As will be evident from FIGS. 2 and 3, the tongue 5 has a thickness which is half the thickness, or at least essentially half the thickness, of the main part 1*a*.

As will clearly be seen from FIG. 1, the width of the tongue 5 is equal to, or at least essentially equal to, the width of the main part 1*a*.

The end region 1*a*' of the main part 1*a* is provided with or shaped as a projection 9 which faces towards the tongue 5 and orientated close to the side surface 8 of said main part 1*a*, this surface being opposite to said one side surface 7 of said main part and orientated between said mutually opposing side surface 7, 8.

The cross-sectional shape of the projection 9 is obtained by allowing the circular surface 5*b* of the tongue 5 to pass beyond the main part 1*a* such as to form a projection whose tip 9*a* is located within the region located between the surfaces 5*b* and 5*a*".

The main part 1*a* is formed with one or two circular projections 10, 11 at its other end 1*a*". The circular projection is/are provided with four uniformly distributed barbs 10*a*, 11*a* and can be affixed to a holding means 2 of known construction and rotated relative thereto when necessary.

Figure 4:
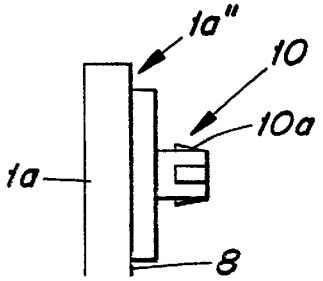
FIG. 4 is a side view of a first type of projection adapted to hold a braces or suspenders clip.
Figure 7:
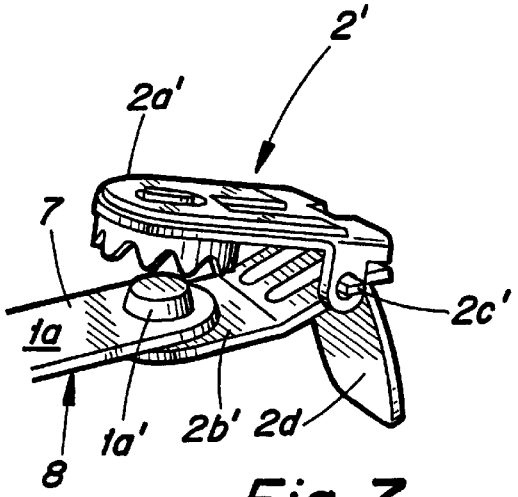
FIG. 7 is a perspective view of a known braces clip, shown in an open state.

FIG. 4 shows a first type of projection 10 on one side surface 8 of the main part 1*a*, this projection being adapted for co-action with a first type of holding means 2, such as a braces clip shown more clearly in FIG. 7.

Figure 5:
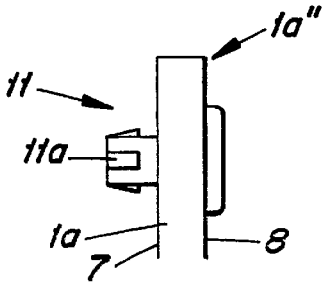
FIG. 5 is a side view of a second type of projection adapted to hold a crocodile clip.

FIG. 5 shows a second type of projection 11 provided on the side surface 7 of the main part 1*a* opposite to said side surface 8, this projection being adapted for co-action with a second type of holding means 2, such as a crocodile clip, shown more clearly in FIG. 1.

Returning to FIG. 3, it will be seen that with the intention of achieving positive and safe co-action between the hook-shaped device 1*b* and the identity card 3, the inner diameter of the curved tongue (i.e. the circular surface 5*b*) and the thickness (b') of the tongue 5 are slightly smaller than the distance "b" from one outer edge 3*a* of the card 2 to a slot defining edge 3*b*' of said card facing towards said outer edge 3*a*.

The main part 1*a* and the hook-shaped device 1*b* of said device are made of a plastic material, preferably a polycarbonate material.

The free end of the tongue is bevelled or rounded 5*d* towards the side surface 8 of the main part, so as to define said slot 6.

Figure 6:
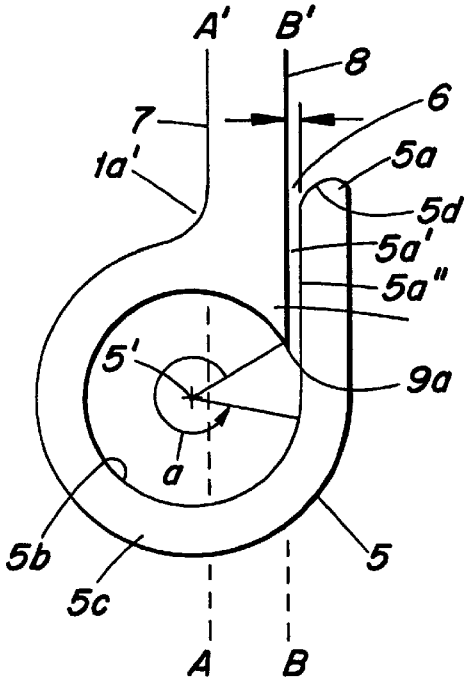
FIG. 6 is a slightly enlarged side view of an alternative embodiment of the hook-shaped device in FIG. 3.

FIG. 6 illustrates an alternative embodiment where the center 5' of the curved tongue 5 is located on one side of a plane "A" that coincides with a plane "A'", e.g. the side surface 7 of the main part 1*a*, and, in a direction away from the plane "B", is orientated to coincide with a plane, e.g. the side surface 8 of the main part.

This lateral offset between the centres 5' shown in FIGS. 2 and 6 shall normally be smaller than 25% of the diameter of the surface 5*b*.

The angle of arc of the curved tongue 5 and its circular surface 5*b* is greater than 320° and smaller than 350°.

In the FIG. 1 illustration, the holding means 2 has the form of a known crocodile clip that includes spring-loaded jaws 2*a*, 2*b* and an intermediate rotary axle 2*c*. The jaw 2*b* is attached to the other end 1*a*" of the main part 1*a* in a known manner.

FIG. 7 illustrates the use of a braces or suspender clip 2' with the jaws 2*a*' and 2*b*' being shown in an open position. An intermediate rotary shaft 2*c*' is also used in this case.

The jaw 2*a*' can be moved to a closed position, by means of a wing-shaped means 2*d*.

Figure 8:
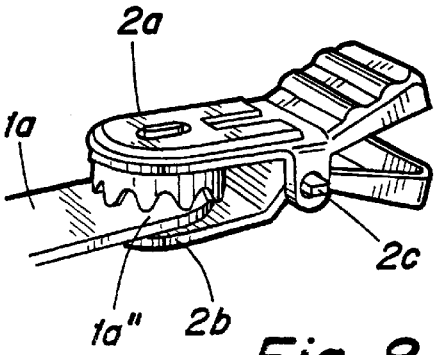
FIG. 8 is a perspective view of a known crocodile clip, in a closed state.

FIG. 8 illustrates an alternative embodiment of a crocodile clip having jaws 2*a*, 2*b*, of which the jaw 2*b* is attached to the other end 1*a*" of the main part 1*a* in a known manner.

It will be understood that the invention is not restricted to the aforedescribed and illustrated exemplifying embodiments thereof and that modifications can be made within the scope of the following Claims.

What is claimed is:

1. A hook-shaped arrangement that comprises:

a main part, a hook-shaped device integral with said main part, and a holding means which is connected to said main part, wherein said hook-shaped device is formed at one end of the main part and adapted to firmly hold an object, while being not readily removable therefrom, and wherein the holding means is connected to the other end of the main part and capable of being attached to and readily removed from a further holding means, wherein the hook-shaped device is comprised of a tongue which has an essentially part-circular cross-sectional shape that has an angle of arc slightly smaller than 360°; the centre of said curved tongue is located essentially in a plane that is orientated to coincide with a plane on one side surface of the main part; and the free end of the tongue extends essentially in a plane which is orientated to coincide with a plane orientated on that side surface of said main part which lies opposite to said one side surface of said main part, and wherein the main part includes a projection which faces towards said tongue and which is located in the close proximity of the side surface of said main part that is opposite to said one side surface of said main part, and orientated between said mutually opposing side surfaces.

2. An arrangement according to claim 1, wherein the angle of arc of said circular cross-sectional surface of the tongue is greater than 300° and smaller than 340°.

3. An arrangement according to claim 2, wherein the thickness of the tongue is essentially half the thickness of the main part of said device.

4. An arrangement according to claim 3, wherein the width of the tongue is equal, or at least essentially equal, to the width of the main part.

5. An arrangement according to claim 1, wherein said main part includes in the proximity of said other end one or two circular, barbed projections adapted for firm attachment to the holding means and capable of being rotated in relation to said means when necessary.

6. An arrangement according to claim 5, wherein said projections include a first type of projection formed on one side surface of said main part and adapted for co-action with a first type of holding means.

7. An arrangement according to claim 6, wherein the first type of holding means includes braces or a suspender clip.

8. An arrangement according to claim 5, wherein said projections include a second type of projection formed on that side surface of the main part which lies opposite said one side surface of said main part, said second type of projection being adapted for co-action with a second type of holding means.

9. An arrangement according to claim 8, wherein the second type of holding means includes a crocodile clip.

10. An arrangement according to claim 1, wherein the diameter of the curved tongue and the thickness of said tongue are slightly less than the distance from an outer edge of an identity card to a slot defining edge of said card that faces towards said outer edge.

11. An arrangement according to claim 1, wherein said main part and said hook-shaped device are comprised of a plastic material.

12. An arrangement according to claim 11, wherein the plastic material includes a polycarbonate material.

13. An arrangement according to claim 1, wherein the free end of the tongue is rounded towards one side surface of said main part.

14. An arrangement according to claim 1, wherein the centre of said curved tongue is located on one side of a plane orientated on one side surface of said main part and in a direction away from the plane orientated on that side surface of the main part which lies opposite to said one side surface of said main part.

15. An arrangement according to claim 14, wherein the angle of arc of the curved tongue is greater than 320° and smaller than 350°.

16. An arrangement according to claim 1, wherein the object includes an identity card, and said hook-shaped device is adapted to firmly hold the identity card, whilst being not readily removable therefrom.

17. An arrangement according to claim 16, wherein the further holding means includes part of a wearer's clothing, and the holding means is capable of being attached to and readily removed from the part of a wearer's clothing.

* * * * *